US005553849A

United States Patent [19]

Slone et al.

[11] Patent Number: 5,553,849

[45] Date of Patent: Sep. 10, 1996

[54] COMBINATION FERROUS METAL-EDGED GAME PIECES AND MAGNETIC REMOVAL WAND

[76] Inventors: Carolyn S. Slone, 6, Oak Glen Dr., Delaware, Ohio 43015; Jeanna K. Slone, 312 E. Cherry St., Sunbury, Ohio 43074; Marjorie J. Moreland, 43 Winter Pine Dr., Delaware, Ohio 43015

[21] Appl. No.: 325,931

[22] Filed: Oct. 19, 1994

[51] Int. Cl.[6] ..... A63F 3/00

[52] U.S. Cl. ..... 273/239

[58] Field of Search ..... 273/236, 237, 273/238, 239, 440, 447, 448

[56] References Cited

U.S. PATENT DOCUMENTS

| | | | |
|---|---|---|---|
| 2,625,396 | 1/1953 | Frechtmann | 273/448 |
| 3,627,316 | 12/1971 | Machinski | 273/448 X |
| 3,684,288 | 8/1972 | Grace | 273/239 |
| 4,005,866 | 2/1977 | Marcil | 273/239 |
| 4,049,275 | 9/1977 | Skelton | 273/239 |
| 4,172,597 | 10/1979 | Smith et al. | 273/239 |
| 4,205,852 | 6/1980 | Wayman . | |
| 4,244,580 | 1/1981 | Hoyles . | |
| 4,299,578 | 11/1981 | Waymen . | |
| 4,395,043 | 7/1983 | Gargione | 273/239 |
| 4,637,613 | 1/1987 | Bishop | 273/239 |
| 4,861,039 | 8/1989 | Phillips et al. | 273/239 |

FOREIGN PATENT DOCUMENTS

| | | | |
|---|---|---|---|
| 2422878 | 12/1979 | France | 273/448 |
| 443726 | 5/1927 | Germany . | |

OTHER PUBLICATIONS

Selchow & Righter 100th Anniversary Game Catalog; Bayshore, NY; Mar., 1968, p. 14.

*Primary Examiner*—William E. Stoll
*Attorney, Agent, or Firm*—Richard C. Litman

[57] ABSTRACT

The present invention relates to a combination of game pieces having a ferrous metal member on a peripheral edge or surrounding the periphery thereof, and a magnetic wand for lifting the pieces from a playing board or surface. Because the pieces themselves are not magnetized, they will not adhere to one another when they are either placed on a game board, or in storage. However, the ferrous metal edging on the game tiles allows them to be easily lifted and removed from a playing board or surface.

5 Claims, 3 Drawing Sheets

FIG. 4
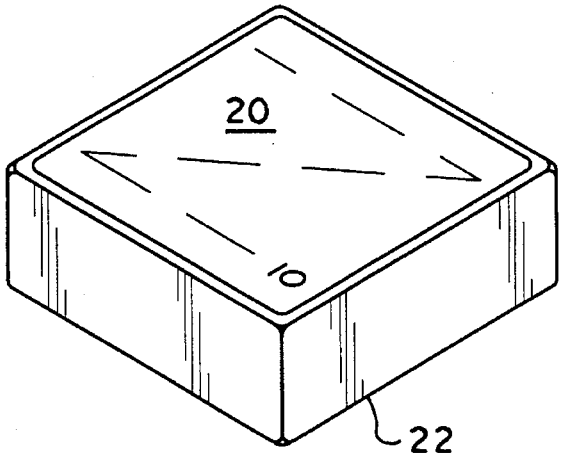
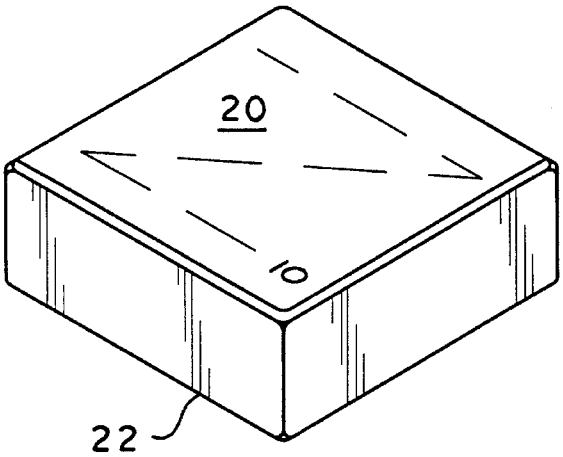
FIG. 5
FIG. 6
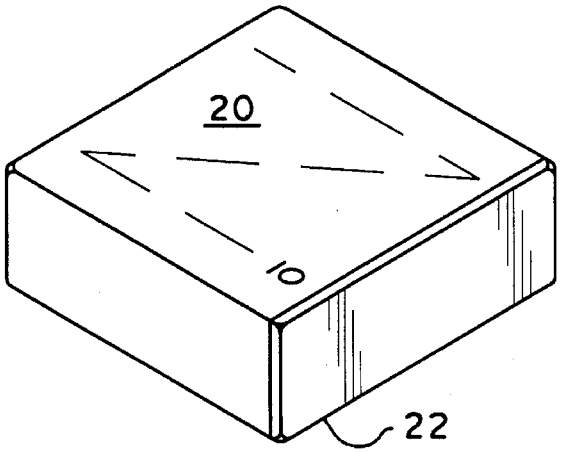

COMBINATION FERROUS METAL-EDGED GAME PIECES AND MAGNETIC REMOVAL WAND

BACKGROUND OF THE INVENTION

1. Field of the Invention

The present invention relates to game pieces which include a ferrous metal edge portion, and a magnetic wand for magnetically removing the game pieces from a game board or playing surface.

2. Description of the Prior Art

Many type of games, especially board games, are played using a plurality of small game pieces. The game pieces normally bear some type of indicia, such as alpha-numeric characters or discernible colors, which distinguish the various game pieces, or groups of game pieces from one another. A host of different games are then played according to fixed sets of rules, either with or without a game board, in which the indicia determine, in some part, how the game pieces can be played.

For example, the game of dominoes is played using a plurality of elongated game pieces each bearing numerical indicia in the form of two sets of dots inscribed on either end of the elongated playing piece. The game is played without a game board, with each player alternately placing a game piece adjacent to another game piece according to a fixed set of rules which interrelate the numerical indicia on the game pieces.

Other examples, in this instance games in which a game board is used, are the many types of cross-word-type word games. Perhaps the most popular and familiar game of this type is Scrabble®. In Scrabble®, a plurality of game pieces in the form of square tiles bearing a single letter of the alphabet and a numerical point value for that letter are used. In play, one or more game pieces are placed on the board by each player, in turn, to spell out approved words. Points are then accumulated using the numerical indicia inscribed on the played game pieces, as well as multiplier indicia inscribed on the game board (e.g., double letter score, double word score, etc.). Often the game board used in such cross word-type games includes a plurality of mating recesses for securely receiving the game pieces. The mating recesses function to ensure that the progressing game is not irretrievably disrupted should the game board be accidentally (or purposefully) jarred or bumped.

An attribute shared by many the above-described games is that each player normally holds a fixed number of game pieces. After each player has made her play, she replenishes her supply of game pieces up to the fixed limit by drawing the requisite number of game pieces from a supply of game pieces. These types of games then often end when there are no more game pieces to be played. For example, in Scrabble®, each player is allowed to hold seven game pieces. After each play, a player is allowed to replenish her cache of game pieces by drawing as many additional game pieces as necessary from a supply to bring her total number of game pieces back to seven. The game ends when there are no game pieces left in the supply, and none of the players can make a play. A similar rule is followed in dominoes, and many other such games.

For instance, U.S. Pat. No. 4,205,852, issued Jun. 3, 1980; and U.S. Pat. No. 4,299,578, issued Nov. 10, 1981, to P. L. Wayman, describe such a cross-word-type word game. The Wayman patents describe a game in which not only can the play of the game be either solitary or competitive, but the end result of the game is a completed cross-word puzzle array. By compiling a "clue" list to match the words of the completed cross-word puzzle array, a player or players of the Wayman game can author a cross-word puzzle, complete with clues and answers, for another person to play.

As in Scrabble®, this game is played with a plurality of square tiles which are inscribed on their top surfaces with a vowel or a consonant. The game is played on a game board made of a material to which a magnetic material will be attracted. Some of the game tiles have a top surface which is made from a magnetic material. These magnetic tiles are placed inverted (i.e., base up), and used as "blanks" in the cross-word puzzle array. (See Wayman '852, column 3, lines 14–31). When the game board itself is inverted, at the conclusion of a game, the magnetic playing tiles cling to the game board, while the other pieces fall off the board, thereby allowing the pieces to be quickly sorted.

A drawback, however, to having a portion of the game tiles being magnetic is that the magnetic game tiles are then attracted to one another. This causes the magnetic game tiles to clump together, and makes separating the tiles difficult. Additionally, it adds more complexity to the manufacture of the game tiles because a portion of the tiles must be made from a magnetic material, while the remainder of the tiles are made from a non-magnetic material. In contrast, the present invention provides for game pieces which are themselves non-magnetic (and hence will not be magnetically attractive), but which include a ferrous metal portion which will be attracted to a magnetic source, such as a magnetized wand.

U.S. Pat. No. 4,244,580, issued Jan. 13, 1981, to F. X. Hoyles, discloses a game board which includes a plurality of recesses arranged in a grid. Playing tiles fit matingly within the recesses to play a variety of cross-word-type games.

The playing tiles are made of thin-gage, magnetic carbon steel. In play, the pieces are selected randomly by inserting a magnet-tipped rod into an open-topped container of playing pieces and drawing out a single playing piece. However, because the game pieces are themselves magnetic, the rod will often draw out two (and possibly more) playing pieces. The specification notes that the rules of the game being played can be adapted to allow the player to either use both of the game pieces, or pick just one of the game pieces.

The present invention is distinct from the device described in Hoyles in that the game pieces of the present invention include a non-magnetic ferrous metal peripheral portion, as opposed to the entire playing piece being magnetic. This allows the game pieces to be magnetically removed from a playing surface using a magnet-tipped wand. However, the game pieces themselves are not magnetic. Therefore they will not cling to one another. Because the game pieces are not magnetically attracted to each other, they can be easily removed from a storage area one at a time. But, because of the ferrous metal peripheral portion, the game pieces can be removed en masse from a playing surface using a magnetically active wand.

German Pat. No. 443726, issued May 5, 1927, describes a cross-word-type game in which the playing pieces have a centrally located, flush-mounted metal dot. ("Eisenstifte" or "Metalstifte", literally "iron piece" or "Metal piece", respectively.) The playing pieces can be lifted by the centrally located metal dot using a magnetic rod. Here, the playing pieces are lifted one at a time from a centrally located metal portion. This is in contrast to the present invention, fully described below, in which game pieces can be lifted from a peripheral edge using a magnetic wand.

None of the above references, taken alone, or in any combination, is seen as describing or rendering obvious the presently claimed invention.

SUMMARY OF THE INVENTION

The present invention is a combination of a plurality of substantially planar game pieces having-a ferrous metal portion surrounding a peripheral portion thereof. The game pieces can be of any regular polygonal shape, such as circles, triangles, squares, pentagons, etc. Or they can be shaped as irregular polygons.

As discussed above, many cross-word-type games include a playing board in which the game pieces fit snugly into recesses within the game board. While the recesses ensure that the game pieces are not accidentally disturbed, it is often difficult to remove the game pieces from the game board once they have been placed within a recess. This is especially true for people who have very long finger nails which they do not want damaged in an attempt to remove a game piece which has become wedged within a recess in the game board. This also true of people who suffer from limited manual dexterity or mobility. For persons afflicted with such debilitating diseases as arthritis or lupus, successfully extricating a game piece from the recesses of, for example, a Scrabble® board, can be extremely difficult, if not impossible.

The present invention solves this problem by providing a combination of game pieces comprising tiles having a peripheral ferrous metal portion, and a magnetic wand for lifting the game pieces by their peripheral edges. In a preferred embodiment, each game piece is in the shape of a square, and a ferrous metal portion is located on a peripheral edge of one side of the square game piece. In this configuration, when the magnetic wand is placed in close proximity to the game pieces, the game pieces are lifted upwardly in a tilted manner by their peripheral edges toward the magnetic wand. The game pieces can thus be easily removed from a game board, or collected in the event that they are accidentally scattered.

The magnetic wand of the present combination takes the form of an elongated member having a first handle end, and a second magnetic end. The second end of the magnetic wand includes a magnetic member attached thereto which is relatively large in comparison to the overall dimensions of each of the game pieces. The magnetic member of the wand will magnetically attract the peripheral edges of the game pieces when passed in close proximity thereto.

BRIEF DESCRIPTION OF THE DRAWINGS

FIG. 4 is a perspective view of the game piece depicted in FIG. 3.

FIG. 5 is another embodiment of a game piece according to the present invention.

FIG. 6 is a third embodiment of a game piece according to the present invention.

DETAILED DESCRIPTION OF THE PREFERRED EMBODIMENTS

Figure 3:
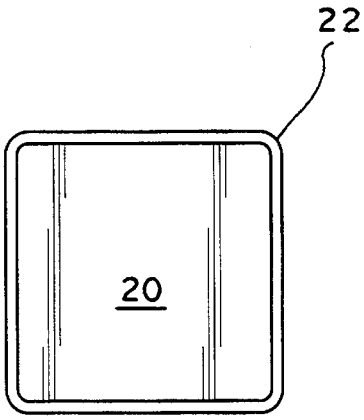
FIG. 3 is a plan view of a game piece according to the present invention having a magnetic portion surrounding a periphery of the game piece.

Reference is made herein to the attached drawing figures. Like reference numerals are used throughout the various drawings to designate like elements of the claimed invention.

Figure 1:
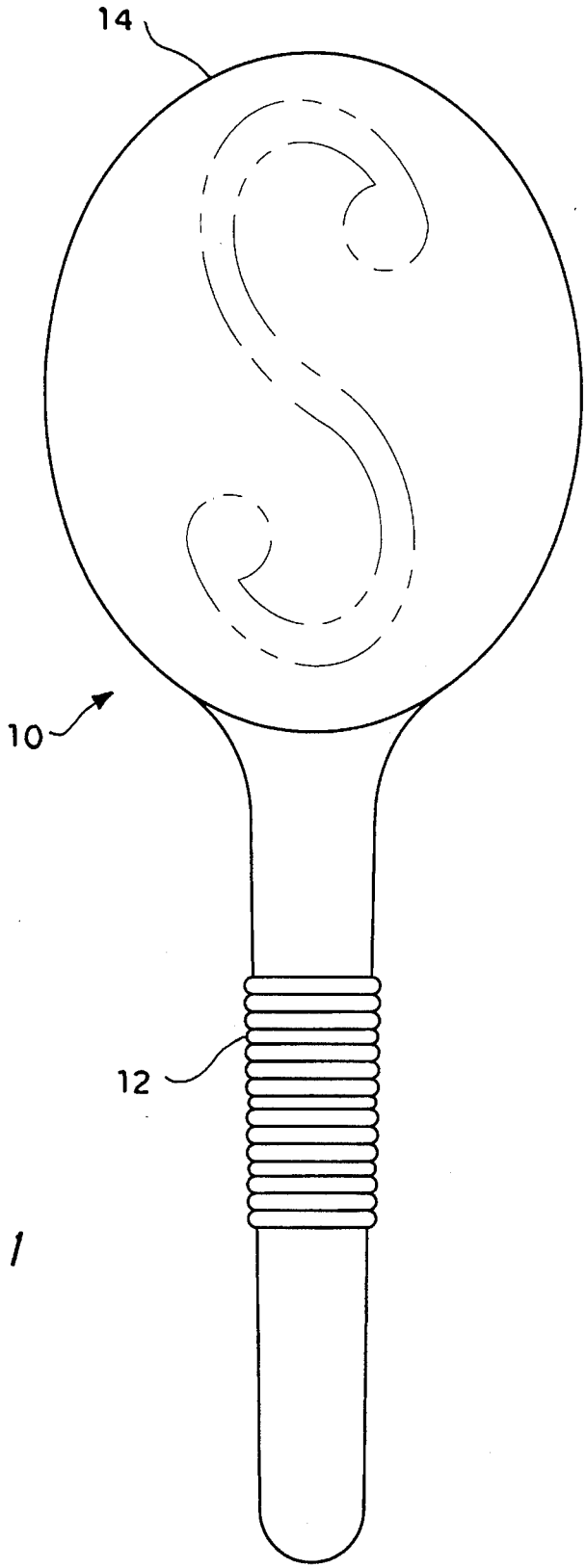
FIG. 1 is a top plan view of a magnetic wand according to the present invention.

FIG. 1 depicts the top surface of a magnetic wand 10 according to the present invention. The magnetic wand 10 is an elongated member having a first handle end 12, and a second magnetic end 14. Decorative designs may be included on any portion of the magnetic wand. The wand may be fabricated from any suitably rigid material such as woods, metals, or synthetic resins.

Figure 2:
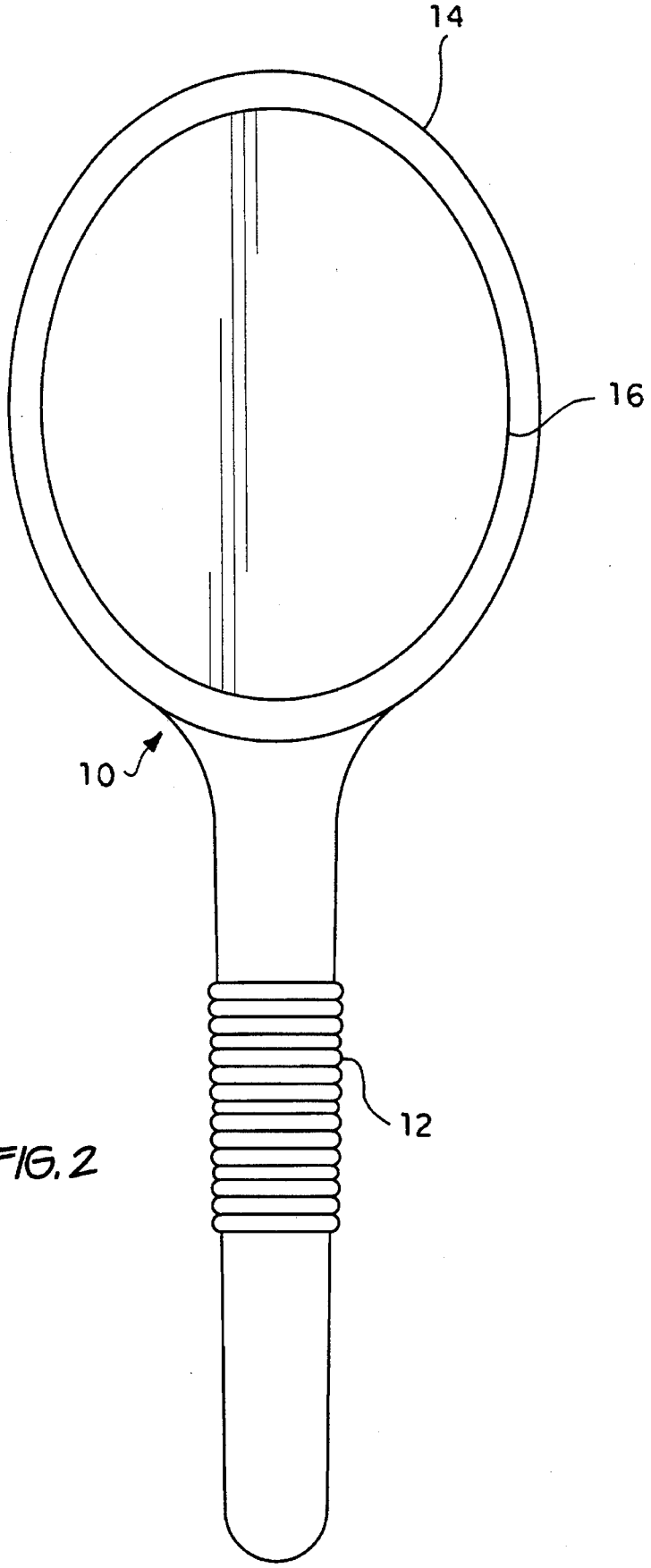
FIG. 2 is a bottom plan view of the magnetic wand.

FIG. 2 depicts the bottom surface of magnetic wand 10, and shows magnetic member 16. Magnetic member 16 may be made from any magnetic substance without limitation, and is magnetically charged, i.e., the magnetic member 16 will attract any ferromagnetic item regardless of whether or not the ferromagnetic item itself is magnetically charged.

Preferably, the magnetic member 16 has a significantly larger exposed surface area than the exposed surface area of an individual game piece when the game piece has been played in a game. This allows the magnetic wand 10 to lift a large number of game pieces simultaneously. It is preferred that the exposed surface area of the magnetic member 10 be from 10 to 50 times larger than the exposed surface area of a single game piece as described above.

FIGS. 3, 4, 5, and 6 depict game pieces 20 according to the present invention. All of the game pieces are depicted as substantially planar, square tiles. The shape of the tiles, however, is not critical to the invention, so long as they remain substantially planar. As noted above, the tiles can be circular, triangular, etc.

Each tile 20 has top and bottom surfaces joined by at least one peripheral edge. The top and bottom surfaces of the tiles are substantially identical, and may have intelligible indicia, such as alphanumeric characters, inscribed thereon. A ferrous metal member 22 is attached to at least one of the peripheral edges 22 of the tiles 20.

FIG. 3 shows a tile 20 in which the ferrous metal member 22 completely surrounds the periphery of the tile. The same tile is shown in perspective in FIG. 4. The top surface of the tile is shown with the letter "Z" and the number "10" inscribed thereon.

FIG. 5 shows a second embodiment of the tile 20 in which two ferrous metal members 22 are attached to two adjacent peripheral edges of the four peripheral edges of the tile.

FIG. 6 shows a third, and the preferred embodiment of the claimed game piece. Here, the tile 20 is shaped in the form a square, and has only one ferrous metal member 22 attached to only one of the four peripheral edges of the tile. Using this arrangement, when the magnetic wand is placed in close proximity to the game piece, the game piece will be lifted upwardly in a tilted manner by peripheral edge bearing the ferrous metal member toward the magnetic wand.

It is to be understood that the invention is not limited in any manner to the embodiments described above, but includes any and all embodiments encompassed by the following claims.

We claim:

1. In combination, a plurality of game pieces each including a ferrous metal portion, and a magnetic wand, each of said plurality of game pieces comprising:

a square tile having top and bottom surfaces joined by four peripheral edges; and a non-magnetic ferrous metal member attached to only two adjacent peripheral edges of said four peripheral edges; and said magnetic wand comprising:

an elongated member having a first handle end, and a second magnetic end, said second end including a magnetic member attached thereto; whereby said plurality of game pieces can be lifted from said peripheral edge by said magnetic wand via magnetic interaction between said magnetic member and said ferrous metal member attached to said peripheral edge.

2. The combination according to claim 1, wherein each of said plurality of game pieces further comprises intelligible indicia inscribed thereon.

3. The combination according to claim 2, wherein said indicia inscribed on each of said plurality of game pieces is inscribed on a surface selected from the group consisting of said top surface of said game piece, said bottom surface of said game piece, and both top and bottom surfaces of said game piece.

4. The combination according to claim 1, wherein said ferrous metal member attached to said at least one peripheral edge of said tile is flush with said top and bottom surfaces of said tile.

5. In combination, a plurality of game pieces each including a ferrous metal portion, a game board, and a magnetic wand, each of said plurality of game pieces comprising:

a square tile having top and bottom surfaces joined by four peripheral edges, and a non-magnetic ferrous metal member attached only to the periphery of one of said peripheral edges of said tile;

said game board including a plurality of mating recesses for receiving said game pieces; and said magnetic wand comprising:

an elongated member having a first handle end, and a second magnetic end, said second end including a magnetic member attached thereto; whereby said plurality of game pieces can be lifted upwardly in a tilted manner from said peripheral edge by said magnetic wand via magnetic interaction between said magnetic member and said ferrous metal member attached to said peripheral edge.

* * * * *